US010863793B2

(12) United States Patent
Bell et al.

(10) Patent No.: US 10,863,793 B2
(45) Date of Patent: Dec. 15, 2020

(54) FOOTWEAR SYSTEM WITH AN ARTICLE OF FOOTWEAR HAVING AN UPPER WITH MEDIAL AND LATERAL SIDE PORTIONS WITH SEPARATELY SECURABLE DISTAL ENDS

(71) Applicant: NIKE, Inc., Beaverton, OR (US)

(72) Inventors: Thomas G. Bell, Portland, OR (US); Hannah Rose Amis, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 261 days.

(21) Appl. No.: 15/575,691

(22) PCT Filed: May 26, 2016

(86) PCT No.: PCT/US2016/034326
§ 371 (c)(1),
(2) Date: Nov. 20, 2017

(87) PCT Pub. No.: WO2016/196194
PCT Pub. Date: Dec. 8, 2016

(65) Prior Publication Data

US 2018/0289099 A1 Oct. 11, 2018

Related U.S. Application Data

(60) Provisional application No. 62/167,928, filed on May 29, 2015, provisional application No. 62/167,927, filed on May 29, 2015.

(51) Int. Cl.
*A43B 13/36* (2006.01)
*A43B 3/06* (2006.01)
(Continued)

(52) U.S. Cl.
CPC ..... *A43B 13/36* (2013.01); *A43B 1/0081* (2013.01); *A43B 3/06* (2013.01); *A43B 3/126* (2013.01); *A43B 11/00* (2013.01); *A43C 11/1493* (2013.01)

(58) Field of Classification Search
CPC ..... A43B 3/06; A43B 3/16; A43B 1/0081; A43B 13/36; A43B 13/28; A43B 3/126;
(Continued)

(56) References Cited

U.S. PATENT DOCUMENTS 1,773,127 A 8/1930 Auster
1,803,554 A 5/1931 Knilans
(Continued)

FOREIGN PATENT DOCUMENTS

CN 202340939 U 7/2012
EP 0988808 A1 3/2000
(Continued)

OTHER PUBLICATIONS

Blue Polyester Flexible Velcro Loop Fabric for Clothing and Bag Adhering, http://www.microfiberclothcleaning.com/sale-4561913-blue-polyester-flexible-velcro-loop-fabric-for-clothing-and-bag-adhering.html, Jun. 3, 2016.
(Continued)

*Primary Examiner* — Megan E Lynch
(74) *Attorney, Agent, or Firm* — Quinn IP Law

(57) ABSTRACT

A footwear system includes an article of footwear that has a sole with a medial side, a lateral side, and a foot-receiving surface. The article of footwear has an upper with a medial side portion and a lateral side portion. The medial side portion is fixed to the medial side of the sole and has a first distal end. The lateral side portion is fixed to the lateral side of the sole and has a second distal end. The medial side portion and the lateral side portion are configured to wrap at
(Continued)

least partially around a foot positioned on the foot-receiving surface. The medial side portion is securable at the first distal end, and the lateral side portion is separately securable at the second distal end remote from the medial side portion when the medial side portion and the lateral side portion are wrapped at least partially around the foot.

17 Claims, 7 Drawing Sheets

(51) Int. Cl.

| | |
|---|---|
| ***A43B 1/00*** | (2006.01) |
| ***A43C 11/14*** | (2006.01) |
| ***A43B 3/12*** | (2006.01) |
| ***A43B 11/00*** | (2006.01) |

(58) Field of Classification Search
CPC .... A61B 11/007; A61B 11/004; A61F 5/0111; A61F 5/0127
See application file for complete search history.

(56) References Cited

U.S. PATENT DOCUMENTS

| | | | | |
|---|---|---|---|---|
| D100,767 | S | 8/1936 | Gerton | |
| 2,068,251 | A | 1/1937 | Ullrich | |
| 2,513,005 | A | 6/1950 | Crawford | |
| 2,611,977 | A | 9/1952 | Yamada | |
| 2,734,285 | A | 2/1956 | Levitt | |
| 3,327,410 | A | 6/1967 | Park, Sr. et al. | |
| 3,834,377 | A | 9/1974 | Lebold | |
| 4,414,759 | A | 11/1983 | Morgan et al. | |
| 4,476,639 | A | 10/1984 | Zaccaria | |
| 4,714,096 | A | 12/1987 | Guay | |
| 4,811,498 | A | 3/1989 | Barret | |
| 4,869,000 | A | 9/1989 | York, Jr. | |
| 4,926,569 | A | 5/1990 | Bunch | |
| 4,941,236 | A | 7/1990 | Sherman et al. | |
| 5,014,448 | A | 5/1991 | Perrone | |
| 5,323,549 | A | 6/1994 | Segel et al. | |
| 5,654,067 | A | 8/1997 | Dinger et al. | |
| 5,699,629 | A | 12/1997 | Munschy | |
| 5,836,090 | A | 11/1998 | Smith | |
| 5,996,189 | A | 12/1999 | Wang | |
| 6,212,798 | B1 | 4/2001 | Koenig et al. | |
| 6,216,496 | B1 | 4/2001 | Gehring | |
| 6,393,733 | B1 | 5/2002 | London et al. | |
| 6,397,638 | B1 | 6/2002 | Roell | |
| 6,460,228 | B1 | 10/2002 | Li | |
| 6,845,639 | B1 | 1/2005 | Hajek | |
| 6,925,734 | B1 | 8/2005 | Schaeffer | |
| 6,968,634 | B2 * | 11/2005 | Dombowsky | A43B 3/163 36/11.5 |
| 7,162,749 | B2 | 1/2007 | Carbone, II et al. | |
| 7,380,354 | B2 | 6/2008 | Yamashita et al. | |
| 7,500,323 | B2 | 3/2009 | Rasmussen | |
| 7,624,517 | B2 | 12/2009 | Smith | |
| 7,845,094 | B1 * | 12/2010 | Gaskins, Jr. | A43C 15/00 36/11.5 |
| 8,263,204 | B2 | 9/2012 | Higashinaka et al. | |
| 8,418,380 | B2 | 4/2013 | Dojan et al. | |
| D683,112 | S | 5/2013 | James | |
| 8,479,415 | B2 | 7/2013 | Berger et al. | |
| 8,656,564 | B2 * | 2/2014 | Chou | A44B 18/0023 24/442 |
| 8,663,187 | B2 | 3/2014 | Sakaguchi | |
| 8,857,077 | B2 | 10/2014 | Kahatsu et al. | |
| 9,220,318 | B2 | 12/2015 | James et al. | |
| 2002/0133974 | A1 * | 9/2002 | Bartolini | A43C 15/06 36/7.7 |
| 2003/0000107 | A1 * | 1/2003 | Blackburn | A43B 3/12 36/7.5 |
| 2003/0009144 | A1 | 1/2003 | Tanzer et al. | |
| 2005/0115111 | A1 * | 6/2005 | Yamashita | A43B 5/00 36/89 |
| 2006/0112735 | A1 * | 6/2006 | Okawa | A44B 18/0023 66/195 |
| 2006/0248748 | A1 * | 11/2006 | Warren | A43B 1/0081 36/9 R |
| 2006/0254090 | A1 * | 11/2006 | Baxter | A43B 3/16 36/59 R |
| 2007/0033836 | A1 * | 2/2007 | Rasmussen | A43B 1/0081 36/50.1 |
| 2007/0261269 | A1 | 11/2007 | Petrie | |
| 2010/0223812 | A1 | 9/2010 | Batanero Bastida | |
| 2010/0313388 | A1 * | 12/2010 | Chou | A44B 18/0023 24/445 |
| 2012/0000094 | A1 | 1/2012 | Fliri | |
| 2012/0117817 | A1 * | 5/2012 | Chamberlin | A43B 1/0081 36/15 |
| 2013/0047467 | A1 | 2/2013 | Roether et al. | |
| 2014/0101824 | A1 | 4/2014 | Spanks | |
| 2014/0157629 | A1 | 6/2014 | Dojan | |
| 2014/0157630 | A1 * | 6/2014 | Gemmen | A43B 3/0078 36/103 |
| 2014/0173934 | A1 | 6/2014 | Bell | |
| 2014/0223782 | A1 * | 8/2014 | Kuzirian | A43B 3/18 36/107 |
| 2014/0345162 | A1 * | 11/2014 | Mitchell | A41B 11/007 36/100 |
| 2014/0352173 | A1 | 12/2014 | Bell et al. | |
| 2014/0352174 | A1 | 12/2014 | Benkovic | |
| 2015/0305442 | A1 * | 10/2015 | Ravindran | A43B 23/28 36/138 |
| 2018/0125153 | A1 * | 5/2018 | Riley | A43B 7/38 |

FOREIGN PATENT DOCUMENTS

| | | | | |
|---|---|---|---|---|
| EP | 2233020 | A1 | 9/2010 | |
| GB | 2168234 | A | 6/1986 | |
| JP | 2000014408 | A | 1/2000 | |
| WO | WO-9612418 | A2 * | 5/1996 | A43B 1/0081 |
| WO | 9701315 | A1 | 1/1997 | |
| WO | 9925300 | A1 | 5/1999 | |
| WO | 0191593 | A2 | 12/2001 | |
| WO | 2012067319 | A1 | 5/2012 | |
| WO | 2015095525 | A1 | 6/2015 | |
| WO | 2015134114 | A1 | 9/2015 | |
| WO | 2016196195 | A1 | 12/2016 | |

OTHER PUBLICATIONS

Velcro Multicam VS Printed Loop Fabric, https://web.archive.org/web/20141024012629/http:/www.cableorganizer.com/velcro-multicam, Jun. 3, 2016.

Adjustable Velcro Headband, https://web.archive.org/web/20151026040718/http:/jmtbeauty.com/shop/headband/adjustable-velcro-headband-b903-black/, Jun. 3, 2016.

Knitted/Woven Fabrics, http://web.archive.org/web/20130109040335/http:/www.perfectex.com/knitted_wovenfabrics.html, Jun. 3, 2016.

Air Jordan 8 (VIII) Original (OG), https://www.kicksonfire.com/what-are-air-jordans/air-jordan-8-viii/air-jordan-8-viii-original-og-aquas-black-bright-concord-aqua-tone/, accessed Nov. 9, 2017.

Stephen Regenold, Vibram's 'Wrap On' Minimalist Furoshiki Footwear, Gear Junkie, https://gearjunkie.com/vibram-furoshiki-shoes, Sep. 2, 2015, 1-9, United States.

* cited by examiner

FOOTWEAR SYSTEM WITH AN ARTICLE OF FOOTWEAR HAVING AN UPPER WITH MEDIAL AND LATERAL SIDE PORTIONS WITH SEPARATELY SECURABLE DISTAL ENDS

TECHNICAL FIELD

The present teachings generally relate to an article of footwear having an upper.

BACKGROUND

Footwear typically includes a sole configured to be located under a wearer's foot to space the foot away from the ground or floor surface. Sole structure can be designed to provide a desired level of cushioning. Athletic footwear in particular sometimes utilizes polyurethane foam or other resilient materials in the sole structure to provide cushioning. It is also beneficial for the sole structure for an article of athletic footwear to have a ground contact surface that provides sufficient traction and durability for a particular athletic endeavor. An upper attached to the sole structure typically surrounds the sides and top of the foot, and often includes a lacing system, a buckle, or other fastening system to tighten the upper around the foot.

DESCRIPTION

Figure 1:
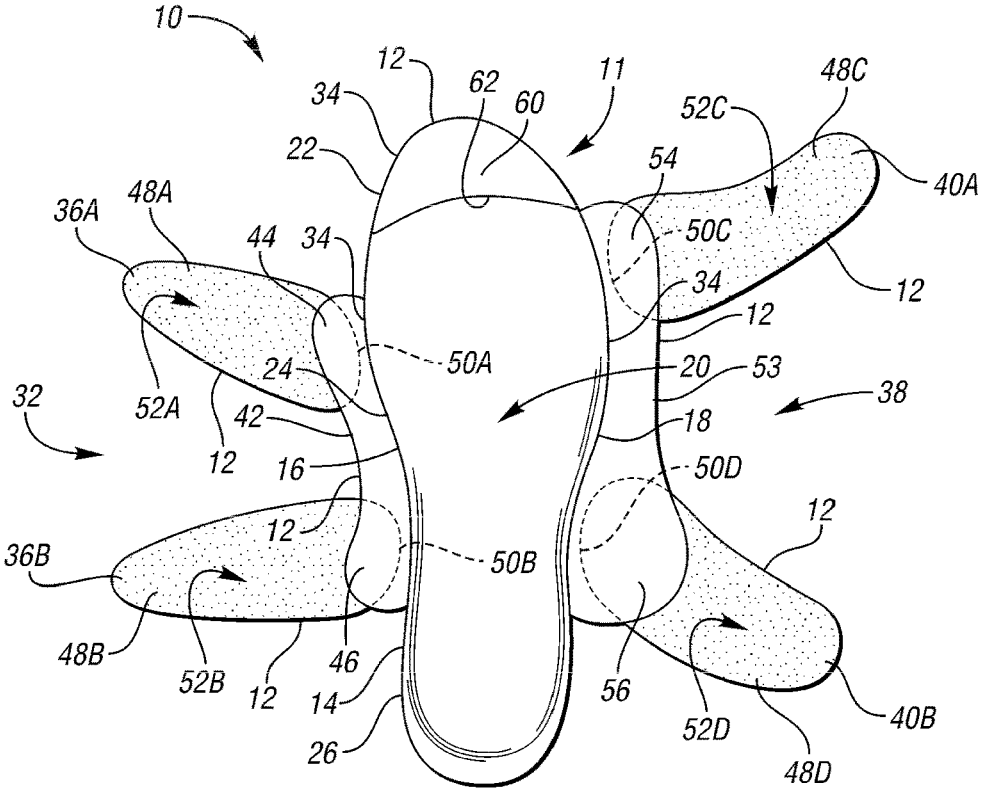
FIG. 1 is a schematic illustration in plan view of a first embodiment of a footwear system with an article of footwear having a medial side portion and a lateral side portion each with a base member and adhesive members.
Figure 2:
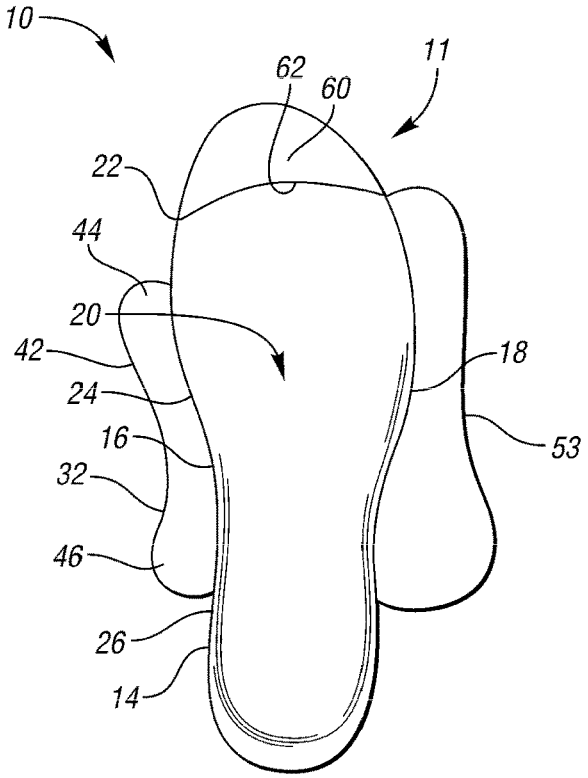
FIG. 2 is a schematic illustration in plan view of the article of footwear of FIG. 1 with the adhesive members removed.

A footwear system is provided that includes an article of footwear that has a sole with a medial side, a lateral side, and a foot-receiving surface. The article of footwear also has an upper that has a medial side portion and a lateral side portion. The medial side portion is fixed to the medial side of the sole and has a first distal end. The lateral side portion is fixed to the lateral side of the sole and has a second distal end. The medial side portion and the lateral side portion are configured to wrap at least partially around a foot positioned by a wearer on the foot-receiving surface. The medial side portion is securable at the first distal end, and the lateral side portion is separately securable at the second distal end remote from the medial side portion when the medial side portion and the lateral side portion are wrapped at least partially around the foot.

In an embodiment, the medial side portion includes a medial base member and an adhesive member. The medial base member is fixed to the medial side of the sole, and the adhesive member includes the first distal end and a proximal end. The adhesive member, which may be referred to as a first adhesive member, is securable to the medial base member at the proximal end, and has an adhesive surface by which the adhesive member is adherable to the wearer at the first distal end. Optionally, the proximal end may also be adherable to the medial base member by the adhesive surface. In another embodiment, the proximal end may be secured to the medial base member in another manner, such as by a fastening mechanism.

The lateral side portion includes a lateral base member fixed to the lateral side of the sole, and may include a second adhesive member. The second adhesive member includes the second distal end and has a proximal end. The second adhesive member may be securable to the lateral base member at the proximal end of the second adhesive member, and has an adhesive surface by which the second adhesive member is adherable to the wearer at the second distal end when the lateral side portion is wrapped at least partially around the foot.

In some embodiments, more than one adhesive member may be secured to the medial base member. For example, the adhesive member may be a first adhesive member securable to the medial base member, and an additional adhesive member may be securable to the medial base member rearward of the first adhesive member. The additional adhesive member may have another adhesive surface adherable to the wearer when the medial support portion is wrapped at least partially around the foot.

The medial base member may have various shapes. In an embodiment, the medial base member has a forward wing configured to wrap at least partially forward around the foot, and a rearward wing configured to wrap at least partially rearward around the foot. The first adhesive member may be secured to the forward wing, and the additional adhesive member may be secured at a proximal end to the rearward wing. The additional adhesive member may have an adhesive surface by which the additional adhesive member is adherable to the wearer when the medial side portion is wrapped at least partially around the foot.

Similarly, the lateral base member may have various shapes. In an embodiment, the lateral base member has a forward wing that wraps at least partially forward around the foot and a rearward wing that wraps at least partially rearward around the foot. The adhesive member may be securable to the forward wing, and an additional adhesive member may have a proximal end securable to the rearward wing of the lateral base member. The additional adhesive member may have an adhesive surface by which the additional adhesive member is adherable to the wearer when the lateral side portion is wrapped at least partially around the foot.

Any or all of the first adhesive member, the second adhesive member, or the additional adhesive member or members may have a first elasticity, and at least one of the medial base member and the lateral base has a second elasticity different from the first elasticity. For example, the adhesive member(s) may be more or less elastic than either or both of the medial and lateral base members. The different elasticities selected may be configured to further enhance the ability of the footwear system to provide an adjustable and supportive fit.

In another embodiment, the footwear system includes a sock configured to be worn on the foot and positioned on the foot-receiving surface. In such an embodiment, the medial side portion includes a fastener portion fixed to the first distal end, and the sock includes an additional fastener portion. The fastener portion of the medial side portion is securable to the additional fastener portion of the sock when the medial side portion is wrapped at least partially around the foot. For example, in one embodiment, the lateral side portion includes a first fastener portion fixed to the second distal end, and the sock includes an additional fastener portion. The fastener portion of the lateral side portion is securable to the additional fastener portion of the sock when the lateral side portion is wrapped at least partially around the foot. In this manner, the medial and lateral portions are separately selectively securable at the first and second distal ends remote from one another.

In an embodiment, the sock includes a base portion that surrounds the additional fastener portion of the sock. The additional fastener portion of the sock includes a first knit configuration. The base portion of the sock includes a second knit configuration different from the first knit configuration. The first knit configuration is configured so that the fastener portion of the medial side portion or of the lateral side portion is selectively securable at the additional fastener portion of the sock. For example, a hook-and-loop fastening system may be used, in which the first knit configuration may be a plurality of loops or a plurality of hooks, and the fastener portion of the medial side portion or the lateral side portion may be the other of the plurality of loops or the plurality of hooks.

In an embodiment, the first knit configuration is a circular knit with a fusible body yarn activated to have hardened loops. For example, the first knit configuration may be integral with the second knit configuration, and only the first knit configuration includes the fusible body yarn. In other words, only the multiple fastener portions of the sock include the fusible body yarn.

A method of manufacturing a knit article, such as a sock, apparel, or footwear, including a footwear upper, may include knitting a base portion of the article with a first set of yarns in a circular knit. The method further includes introducing a fusible yarn, and then knitting at least one fastener portion of the article integrally with the base portion in a circular knit with the fusible yarn as a body yarn in the at least one fastener portion. The method may include activating the fusible yarn such that loops of the fusible body yarn harden. For example, activating the fusible yarn may be by heating the article, such as by but not limited to steaming the article. The loops may serve as loops in a hook-and-loop fastening system. Optionally, the method may include cutting the loops so that they form hooks and serve as hooks in a hook-and-loop fastening system.

In an embodiment, the sock has multiple fastener portions spaced from one another, and the medial side portion and the lateral side portions are selectively securable to different ones of the multiple fastener portions of the sock. The base portion may surround each of the multiple fastener portions of the sock. For example, the medial side portion may include a first fastener portion fixed to the first distal end, and the lateral side portion may include a second fastener portion fixed to the second distal end. The first fastener portion may be securable to at least one of the multiple fastener portions of the sock when the medial side portion is wrapped at least partially around the foot, and the second fastener portion may be securable to at least one other of the multiple fastener portions of the sock when the lateral side portion is wrapped at least partially around the foot.

In an embodiment, a fastener portion of one of the rearward wings (i.e., a first rearward wing) secures to one of the multiple fastener portions of the sock at a heel region of the sock, and an additional fastener portion of the other rearward wing crosses over and secures to the first rearward wing or to the fastener portion of the sock at the heel region.

The adhesive members can have a variety of shapes and sizes. For example, each of the adhesive members may taper in width from the proximal end to the distal end. Each of the adhesive members may have substantially the same shape and size, so that they can be interchangeable positioned on the medial and lateral side portions. Alternatively, the adhesive members can have different shapes and sizes. For example, adhesive members that are longer or wider can be used on the medial side portion versus on the lateral side portion, or on the rearward wings versus on the forward wings.

The above features and advantages and other features and advantages of the present teachings are readily apparent from the following detailed description of the modes for carrying out the present teachings when taken in connection with the accompanying drawings.

"A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., are used descriptively relative to the figures, and do not represent limitations on the scope of the invention, as defined by the claims.

Referring to the drawings, wherein like reference numbers refer to like or identical components, FIG. 1 illustrates a footwear system 10 that includes an article of footwear 11. The article of footwear 11 includes an upper 12 that has separately securing portions 32, 38 that enable the upper 12 to swaddle the foot 28 shown in phantom in FIGS. 3 and 4, and provide adjustable lift and support to a midfoot portion of the foot.

The article of footwear system 11 includes a sole 14 to which the upper 12 is secured. The sole 14 has a medial side 16, a lateral side 18, and a foot-receiving surface 20. The foot-receiving surface 20 generally faces upward and extends over a forefoot portion 22, a midfoot portion 24, and a heel portion 26 of the sole 14. The heel portion 26 generally corresponds with rear portions of a human wearer's foot 28 (shown in phantom in FIGS. 3 and 4), including the calcaneus bone, with the foot 28 corresponding in size to the article of footwear 11. The forefoot portion 22 generally includes portions of the article of footwear 11 corresponding with the toes and the joints connecting the metatarsals with the phalanges of the foot 28. The midfoot portion 24 generally corresponds with an arch area of the foot 28, including the navicular joint, and extends from the forefoot portion 22 to the heel portion 26. The footwear system 10 shown is for a right foot. A pair of footwear includes the article of footwear 11, and an article of footwear for a left foot that is a mirror image of the article of footwear 11.

Figure 3:
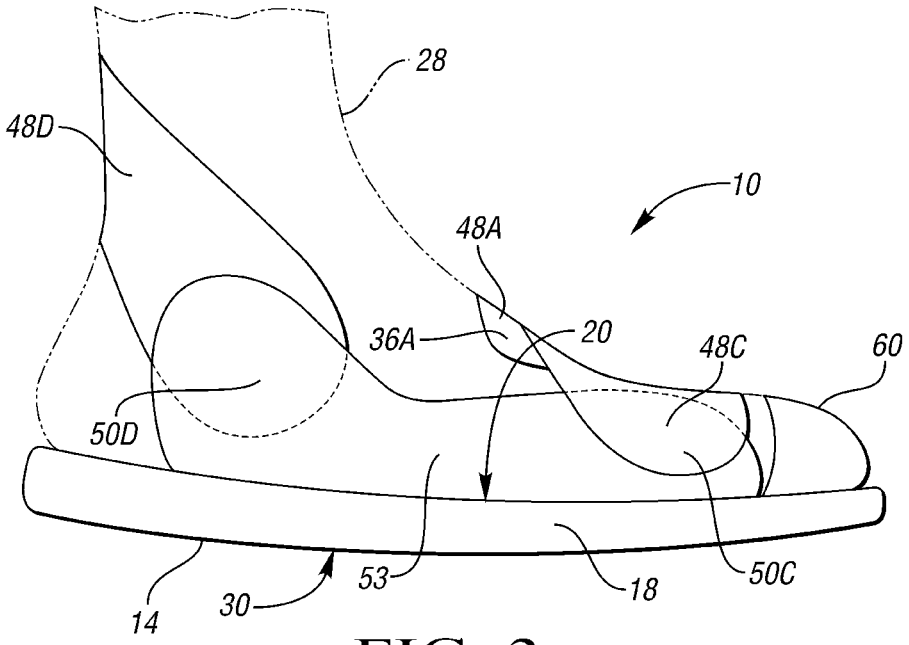
FIG. 3 is a schematic illustration in side view of a lateral side of the article of footwear of FIG. 1 secured to a foot shown in phantom.
Figure 4:
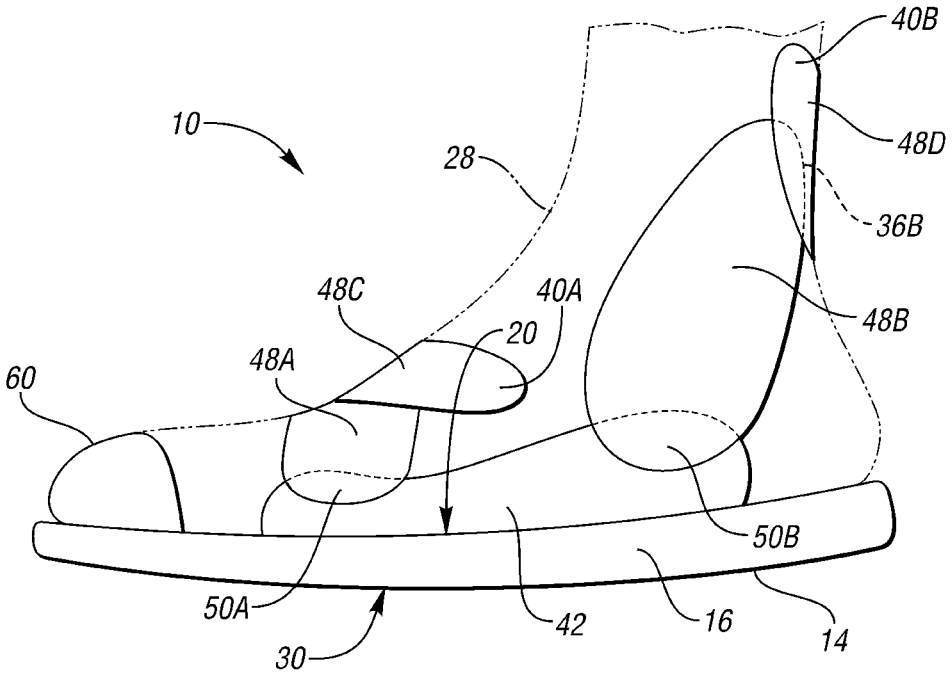
FIG. 4 is a schematic illustration in side view of the medial side of the article of footwear of FIG. 1 secured to the foot shown in phantom.

An opposite side of the sole 14, indicated in the side views of FIGS. 3 and 4, serves as a ground-contact surface 30 of the article of footwear 11. As shown, the article of footwear 11 is an athletic shoe, such as for track and field. The sole 14 may be equipped with spikes, cleats, or other ground-engaging members. In other embodiments, the article of footwear 11 could be for another category of footwear, such as a dress shoe, a work shoe, a sandal, a slipper, or a boot.

The upper 12 includes a medial side portion 32 that is fixed to the periphery 34 of the sole 14 at the medial side 16 of the sole 14. The medial side portion 32 extends to a first distal end 36A that is remote from the medial side 16. Similarly, the upper 12 has a lateral side portion 38 that is fixed to the lateral side 18 of the sole 14. The lateral side portion 38 extends to a second distal end 40A that is remote from the lateral side 18. In FIG. 1, the medial side portion 32 and the lateral side portion 38 are shown extended laterally outward from the sole 14. The medial side portion 32 and the lateral side portion 38 are generally flat and flexible and, when wrapped at least partially around the foot 28, as explained herein, extend generally upward from the medial side 16 and from the lateral side 18, as shown in FIGS. 3 and 4. For example, in some embodiments, the medial side portion 32 and the lateral side portion 38 may be a woven or knitted fabric or textile, rubber, or leather.

As used herein, an "end" generally refers to a distal portion of a component, and is not limited to but includes an absolute extremity of the component. The first distal end 36A and the second distal end 40A may be referred to as "free" ends as they are unfixed and freely movable relative to the sole 14, except when they are selectively secured as described herein.

The medial side portion 32 and the lateral side portion 38 are configured to wrap at least partially around the foot 28 positioned on the foot-receiving surface 20. The medial side portion 32 is securable at the first distal end 36A to the wearer, such as to the foot 28, and the lateral side portion 38 is separately securable to the wearer, such as to the foot 28, at the second distal end 40A remote from the medial side portion 32 when the medial side portion 32 and the lateral side portion 38 are wrapped at least partially around the foot 28 as described herein.

More specifically, the medial side portion 32 includes a medial base member 42 fixed to the medial side 16 of the sole 14. The medial base member 42 includes a forward wing 44 and a rearward wing 46. The medial base member 42 is generally rounded and flares outward at the forward wing 44 and the rearward wing 46. In other embodiments, the medial base member 42 could have a different shape, including a shape without wings.

The medial side portion 32 also includes an adhesive member 48A that includes the first distal end 36A. The adhesive member 48A also has a proximal end 50A, and has an adhesive surface 52A by which the adhesive member 48A is selectively securable to the forward wing 44 of the medial base member 42 at the proximal end 50A. The adhesive surface 52A has adhesive at least at the first distal end 36A and at the proximal end 50A, and may have adhesive over the entire adhesive surface 52A.

The medial side portion 32 further includes an additional adhesive member 48B having another adhesive surface 52B by which the adhesive member 48B is securable to the rearward wing 46 of the medial base member 42 at a proximal end 50B, rearward of the adhesive member 48A. The adhesive member 48B extends to a distal end 36B. The adhesive surface 52B has adhesive at least at the first distal end 36B and at the proximal end 50B, and may have adhesive over the entire adhesive surface 52B.

The lateral side portion 38 includes a lateral base member 53 fixed to the lateral side 18 of the sole 14. The lateral base member 53 includes a forward wing 54 and a rearward wing 56. The lateral base member 53 is generally rounded and flares outward at the forward wing 54 and the rearward wing 56. In other embodiments, the lateral base member 53 could have a different shape, including a shape without wings.

The lateral side portion 38 also includes an adhesive member 48C that includes the second distal end 40A. The adhesive member 48C also has a proximal end 50C, and has an adhesive surface 52C by which the adhesive member 48C is selectively securable to the forward wing 54 of the lateral base member 53 at the proximal end 50C. The adhesive surface 52C has adhesive at least at the second distal end 40A and at the proximal end 50C, and may have adhesive over the entire adhesive surface 52C.

The lateral side portion 38 further includes an additional adhesive member 48D having another adhesive surface 52D by which the adhesive member 48D is securable to the rearward wing 56 of the lateral base member 53 at a proximal end 50D, rearward of the second adhesive member 48C. The adhesive member 48D extends to a distal end 40B. The adhesive surface 52D has adhesive at least at the second distal end 40B and at the proximal end 50D, and may have adhesive over the entire adhesive surface 52C.

Although the proximal ends 50A, 50B, 50C, 50D are shown and described as securing by the adhesive surfaces 52A, 52B, 52C, and 52D to the medial and lateral base members 42, 53, any or all of the proximal ends 50A, 50B, 50C, 50D could instead be secured to the respective medial or lateral base member 42, 53 with a snap, button, hook-and-loop fastening system or otherwise.

As used herein, the adhesive member 48A may be referred to as a first adhesive member, and the adhesive member 48C may be referred to as a second adhesive member. The adhesive members 48A, 48B, 48C, and 48D are relatively thin, flat, and flexible. The adhesive surfaces 52A, 52B, 52C, 52D each include an adhesive configured to adhere to and remain secured to the medial and lateral base members 42, 53 as described during wearing of the footwear system 10. The adhesive surfaces 52A, 52B, 52C, 52D are also configured to adhere to human skin such as on the foot 28, the ankle, and/or the lower leg of the wearer. The adhesive surfaces 52A, 52B, 52C, 52D are configured to release from the medial and lateral base members 42, 53 and from the foot 28 upon a predetermined peel force without damage to the base members 42, 53 or to the foot 28. For example, the adhesive members 48A, 48B, 48C, 48D may be similar in configuration to elastic adhesive bandages or tape, and may be an elastic cotton strip with an acrylic adhesive on the adhesive surface 52A, 52B, 52C, 52D. Securing the adhesive members 48A, 48B, 48C, 48D to the wearer as described secures the article of footwear 11 to the foot 28. No laces, ties, or other components are needed to secure the article of footwear 11 to the foot 28 and maintain the article of footwear 11 on the foot 28 during wear.

In the embodiment of FIG. 1, the adhesive members 48A, 48B, 48C, 48D generally taper in width from the respective proximal end 50A, 50B, 50C, 50D to the distal end 36A, 36B, 40A, 40B, and vary slightly in shape and size relative to one another. In other embodiments, the adhesive members 48A, 48B, 48C, and 48D can be identical in shape and size so as to be interchangeably used. In still further embodiments, the adhesive members 48A, 48B, 48C, 48D can vary even more greatly in shape and size, such as in width and/or length. Different sets of adhesive members may be used to accommodate different needs and preferences of the wearer. Different sets of adhesive members 48A, 48B, 48C, 48D having different shapes, colors, textures, designs, and/or adhesiveness can be used for different functions, such as training, competition, or leisure. For example the outer surfaces of the adhesive members 48A, 48B, 48C, 48D can have various colors, patterns, designs, logos, indicia, printing to vary the style of the footwear system 10.

The upper 12 further includes a forefoot pocket 60 secured to the periphery 34 of the sole 14 at the forefoot portion 22. The forefoot pocket 60 has an open side 62. When the foot 28 is placed on the foot-receiving surface 20, the forefoot is slipped under the forefoot pocket 60 at the open side 62. Other configurations of the upper 12 may be used to secure the foot 28 at the forefoot portion 22. For example, one or more straps may be secured at either end to the periphery 34 at the forefoot portion 22, and can span across the sole 14 at the forefoot portion 22 in lieu of a forefoot pocket 60.

Although not shown in the embodiment of FIGS. 1-4, the upper 12 may also include a heel member that extends generally upward from the periphery 34 at the heel portion 26 of the sole 14. The heel member may be configured to surround a heel portion of the foot 28.

To wear the footwear system 10, a wearer must secure the adhesive members 48A, 48B, 48C, 48D to the medial and lateral base members 42, 53 as shown and described with respect to FIG. 1. Securing the adhesive members 48A, 48B, 48C, 48D to the medial and lateral base members 42, 53 can be done either before or after the wearer places his foot 28 on the foot receiving surface 20. The adhesive members 48A, 48B, 48C, 48D can be secured to the medial and lateral base members 42, 53 so that they extend outward at different angles. For example, as shown in FIG. 1, the adhesive member 48A is secured so that the first distal end 36A points slightly forward, and the adhesive member 48B is secured so that the distal end 36B points slightly rearward. However, either or both could instead be secured to be slightly turned relative to the positions shown, to meet the preferences of the individual wearer. The positioning of the adhesive members 48C, 48D can be selectively varied in a similar manner.

The adhesive members 48A, 48B, 48C, 48D can then be wrapped at least partially around the foot 28 and secured to the wearer in any order. For example, in the embodiment of FIGS. 1-4, by holding the adhesive member 48A near the first distal end 36A and pulling it over and around the top of the foot 28 toward the lateral side 18, the forward wing 44 is wrapped at least partially forward around the foot 28, and the first adhesive member 48A wraps over and around the foot and is secured to the wearer's foot 28, ankle, or lower leg by the adhesive surface 52A, with the first distal end 36A now being adhered near the lateral side 18, as shown in FIG. 3.

The adhesive member 48C is then held near the second distal end 40A and is pulled over and around the top of the foot 28 toward the medial side 16, causing the forward wing 54 to wrap at least partially forward around the foot 28. The adhesive member 48C is secured to the wearer's foot 28, ankle, or lower leg by the adhesive surface 52C, with the second distal end 40A now being adhered near the medial side 16, as shown in FIG. 4. Optionally, depending on the preferred placement of the adhesive members 48A, 48C, the adhesive member 48C can cross over and adhere to the outer surface of the first adhesive member 48A (i.e., the surface on the side of the adhesive member 48A, or vice versa, and/or a portion or all of each adhesive member 48A, 48C is separately directly secured to the foot 28. In the embodiment shown, each of the distal ends 36A, 40A is secured directly to the foot 28.

The additional adhesive members 48B, 48D can then be wrapped around the foot 28 and secured to the wearer in either order. Alternatively, the adhesive members 48B, 48D could be wrapped around and secured to the wearer prior to the adhesive members 48A, 48C. In the embodiment shown, adhesive member 48B is held near the distal end 36B and then is pulled upward along the medial side 16 and slightly rearward around the foot 28 to the back of the ankle, causing the rearward wing 46 to wrap at least partially rearward around the foot 28. The adhesive member 48B is secured to the foot 28 by the adhesive surface 52B, with the distal end 36B now being adhered over the ankle on the medial side, as shown in FIG. 4. Finally, the adhesive member 48D is held near the distal end 40B and then is pulled upward along the lateral side 18 and slightly rearward around the back of the foot 28, causing the rearward wing 56 to wrap at least partially rearward around the foot 28. The adhesive member 48D is secured to the foot 28 by the adhesive surface 52D, with the distal end 40B now being adhered over the ankle on the medial side, as shown in FIG. 4. Optionally, depending on the preferred placement of the adhesive members 48B, 48D, the adhesive member 48D can cross over and adhere to the outer surface of the adhesive member 48B, or vice versa, and/or a portion or all of each adhesive member 48B, 48D is separately directly secured to the foot 28. In the embodiment shown, each of the distal ends 36B, 40B is secured directly to the foot 28.

To remove the footwear system 10, the wearer simply reverses the process, by lifting the distal ends 36A, 36B, 40A, 40B away from the foot 28 to peel the adhesive members 48A, 48B, 48C, 48D off of the foot 28. The foot 28 can then be slipped out of the pocket 60 and off of the foot-receiving surface 20. Optionally, the adhesive members 48A, 48B, 48C, 48D may remain secured at the proximal ends 50A, 50B, 50C, 50D to the medial and lateral base members 42, 53 as shown in FIG. 1, to be re-adhered to the foot 28 when the footwear system 10 is next worn. After a number of wearings, the adhesion of the adhesive surfaces 52A, 52B, 52C, 52D may lessen, at which point the adhesive members 48A, 48B, 48C, 48D can be removed from the medial and lateral base members 42, 53, and a replacement set of adhesive members can be secured to the medial and lateral base members 42, 53.

Figure 5:
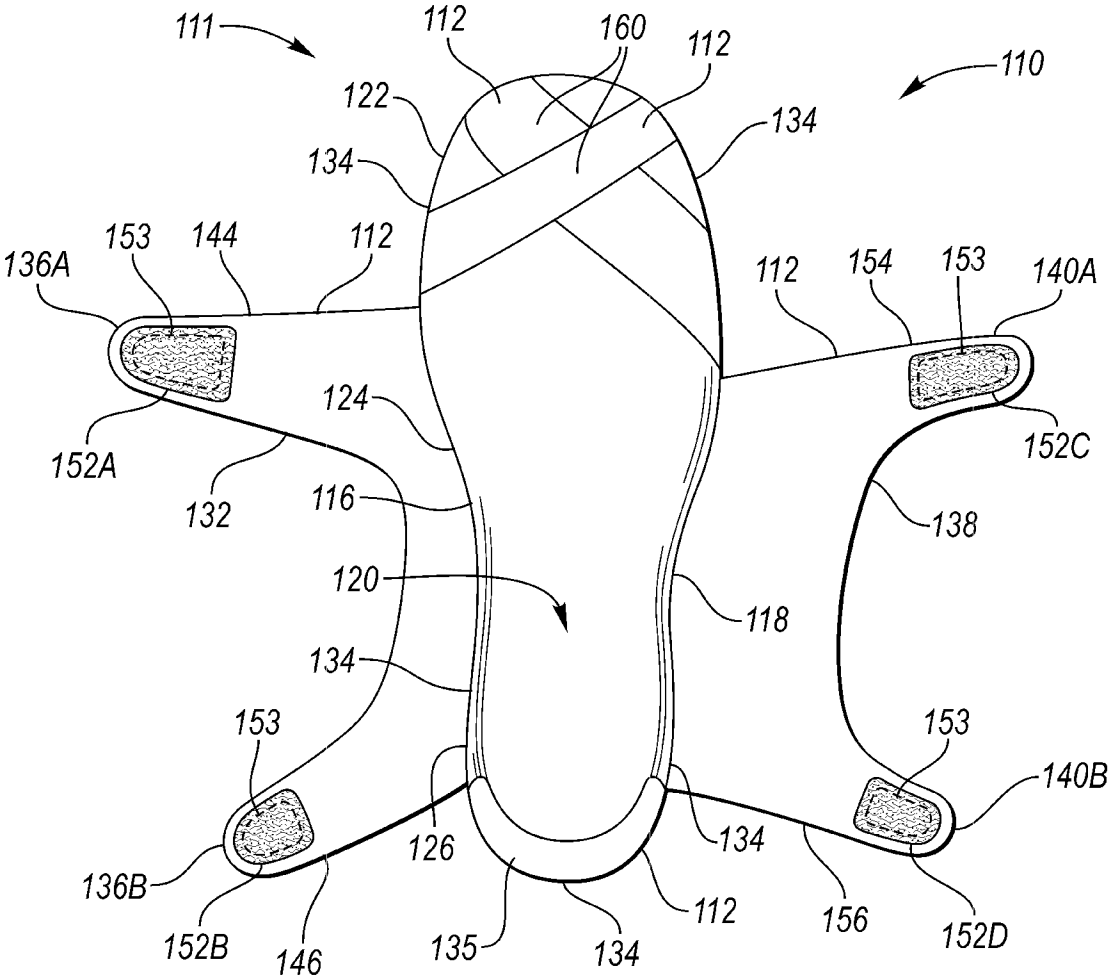
FIG. 5 is a schematic illustration in plan view of a second embodiment of an article of footwear for a footwear system in accordance with an alternative aspect of the present teachings.
Figure 6:
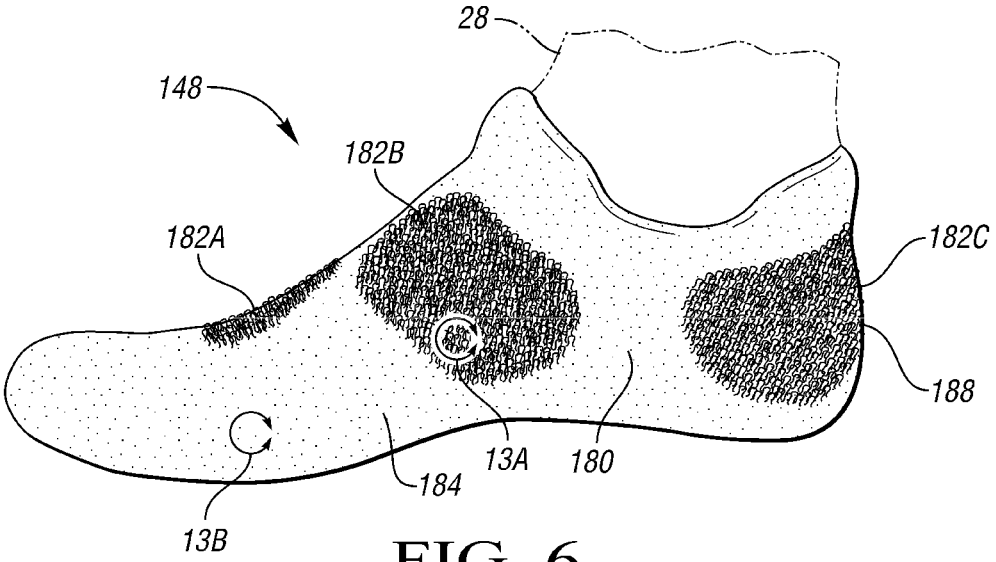
FIG. 6 is a schematic illustration in side view of a medial side of a sock for the footwear system of FIG. 5.
Figure 7:
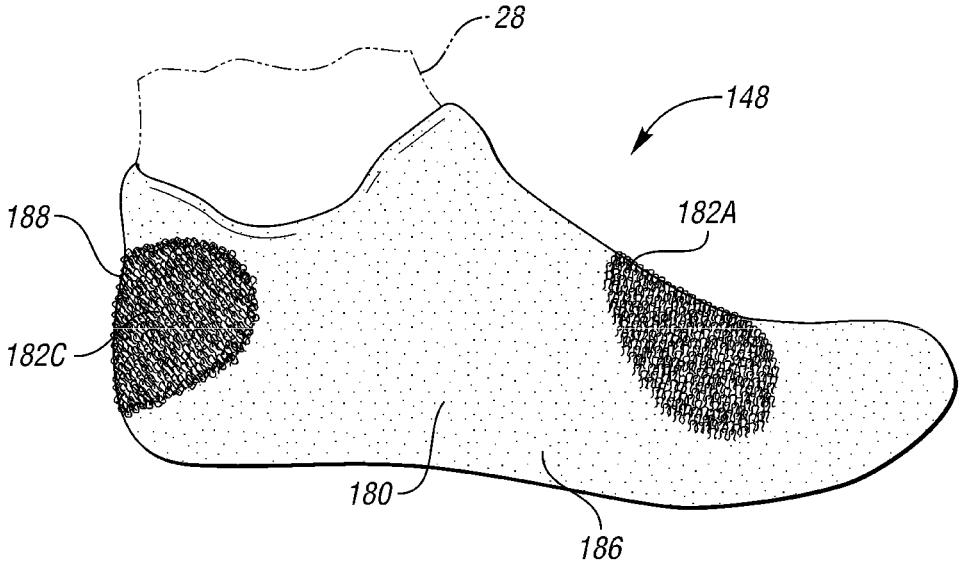
FIG. 7 is a schematic illustration in side view of a lateral side of the sock of FIG. 6.

FIGS. 5-12 show an alternative embodiment of a footwear system 110. The footwear system 110 includes both an article of footwear 111, shown in FIG. 5, and a sock 148 configured to be worn on a foot 28, as shown in FIG. 7. The article of footwear 111 includes an upper 112 that has discreet, separately securing medial and lateral side portions 132, 138 that enable the upper 112 to swaddle the foot 28, and provide adjustable lift and support to a midfoot portion of the foot 28 such as at the navicular joint. As discussed herein, the upper 112 is selectively securable to the sock 148.

Figure 9:
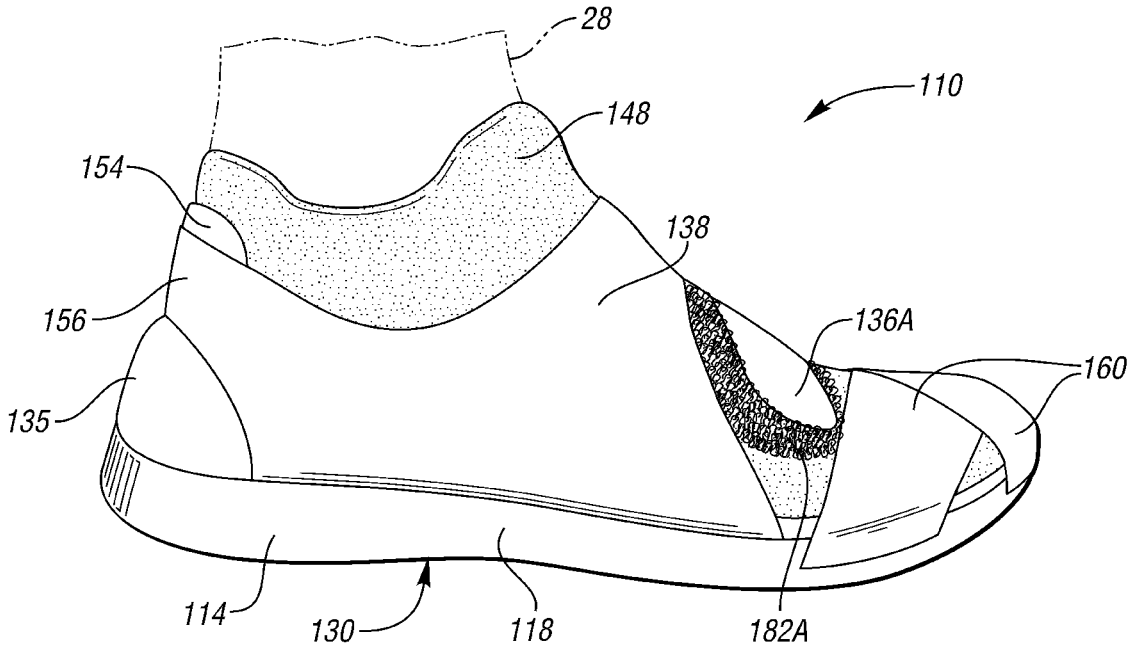
FIG. 9 is a schematic illustration in side view of a lateral side of the footwear system of FIG. 8.
Figure 10:
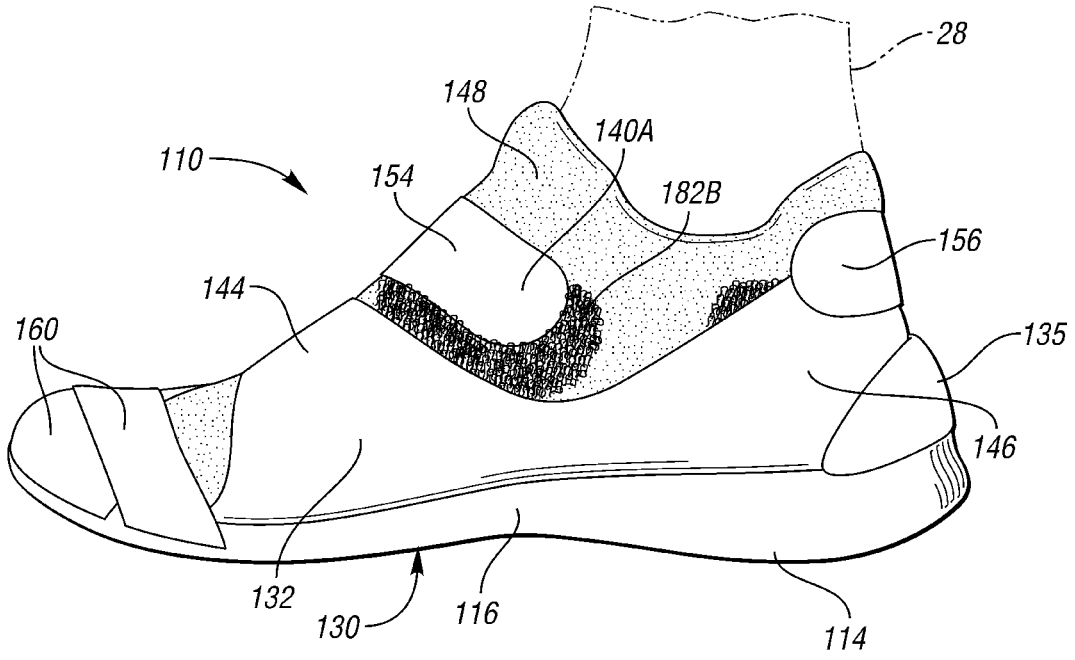
FIG. 10 is a schematic illustration in side view of a medial side of the footwear system of FIG. 8.
Figure 11:
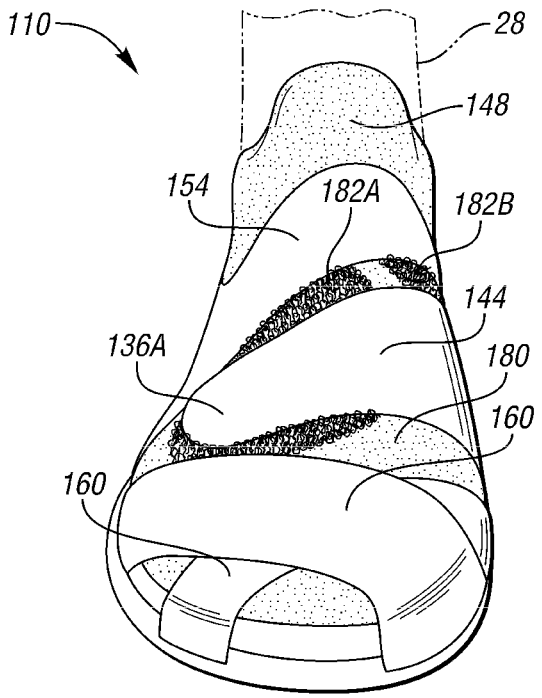
FIG. 11 is a schematic illustration in perspective view of the forefoot portion of the footwear system of FIG. 8.

The article of footwear 111 includes a sole 114, best shown in FIGS. 9 and 10, to which the upper 112 is secured. The sole 114 has a medial side 116, a lateral side 118, and a foot-receiving surface 120 (shown in FIG. 5). A wearer's foot 28 with the sock 148 on the foot 28 is placed on the foot-receiving surface 120. The foot-receiving surface 120 generally faces upward and extends over a forefoot portion 122, a midfoot portion 124, and a heel portion 126 of the sole 114. The heel portion 126 generally corresponds with rear portions of the human wearer's foot 28, including the calcaneus bone, with the foot 28 corresponding in size to the article of footwear 111. The forefoot portion 122 generally includes portions of the article of footwear 111 corresponding with the toes and the joints connecting the metatarsals with the phalanges of the foot 28. The midfoot portion 124 generally corresponds with an arch area of the foot 28, including the navicular joint, and extends from the forefoot portion 122 to the heel portion 126.

An opposite side of the sole 114, indicated in the side views of FIGS. 9 and 10, serves as a ground-contact surface 130 of the article of footwear 111. As shown, the article of footwear 111 is an athletic shoe, such as for track and field. The sole 114 may be equipped with spikes, cleats, or other ground-engaging members. In other embodiments, the article of footwear 111 could be for another category of footwear, such as a dress shoe, a work shoe, a sandal, a slipper, or a boot.

With reference to FIG. 5, the upper 112 includes a medial side portion 132 that is fixed to a periphery 134 of the sole 114 at the medial side 116 of the sole 114. The medial side portion 132 extends to a first distal end 136A that is remote from the medial side 116. The medial side portion 132 has a forward wing 144 that includes the first distal end 136A. The forward wing 144 wraps at least partially forward around the foot 28 as described herein. The medial side portion 132 also has a rearward wing 146 that wraps at least partially rearward around the foot 28 as described herein.

Similarly, the upper 112 has a lateral side portion 138 that is fixed to the lateral side 118 of the sole 114. The lateral side portion 138 extends to a second distal end 140A that is remote from the lateral side 118. In FIG. 5, the medial side portion 132 and the lateral side portion 138 are shown extended laterally outward from the sole 114. The lateral side portion 138 has a forward wing 154 including the second distal end 140A. The forward wing 154 wraps at least partially forward around the foot 28. The lateral side portion 138 also has a rearward wing 156 that wraps at least partially rearward around the foot 28.

The upper 112 further includes straps 160 secured at either end to the periphery 134 at the forefoot portion 122. The straps 160 span across the sole 114 at the forefoot portion 122. When the foot 28 is placed on the foot-receiving surface 120, the forefoot portion of the foot 28 is slipped under the straps 160. Other configurations of the upper 112 may be used to secure the foot 28 at the forefoot portion 122 of the sole 114. For example, a forefoot pocket similar to that of FIG. 1 may be used.

Figure 12:
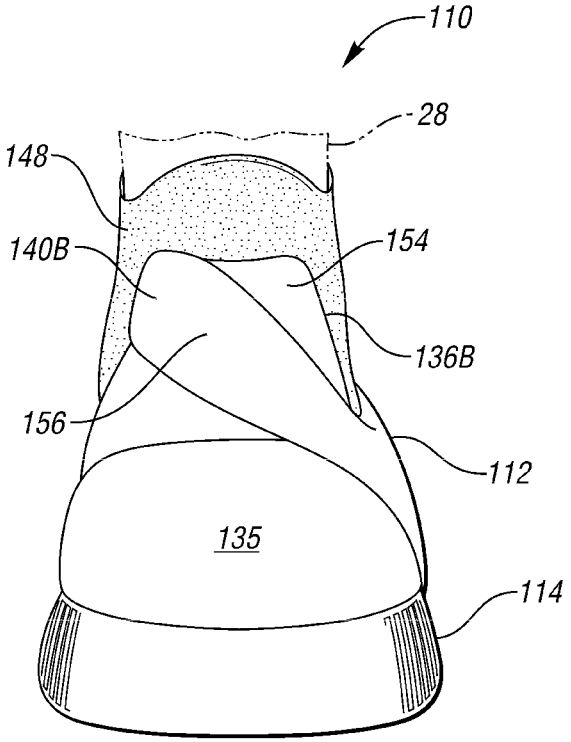
FIG. 12 is a schematic illustration in perspective view of the rear of the footwear system of FIG. 8.

The upper 112 also includes a heel member 135 that extends generally upward from the periphery 134 at the heel portion 126 of the sole 114. The heel member 135 is configured to surround a heel portion of the foot 28 as shown in FIGS. 9, 10 and 12.

The medial side portion 132 and the lateral side portion 138 each have fastener portions that enable the upper 112 to be selectively secured to the sock 148. A first fastener portion 152A is fixed to the first distal end 136A of the forward wing 144. The rearward wing 146 of the medial side portion 132 has an additional fastener portion 152B fixed to a distal end 136B of the rearward wing 146. A second fastener portion 152C is fixed to the second distal end 140A of the forward wing 154. An additional fastener portion 152D is fixed to the rearward wing 156 of the lateral side portion 138. The fastener portions 152A, 152B, 152C, 152D are shown fixed to the upper 112 with stitching 153. Alternatively, the fastener portions 152A, 152B, 152C, 152D can be bonded or adhered to the medial side portion 132 and the lateral side portion 138.

Figure 8:
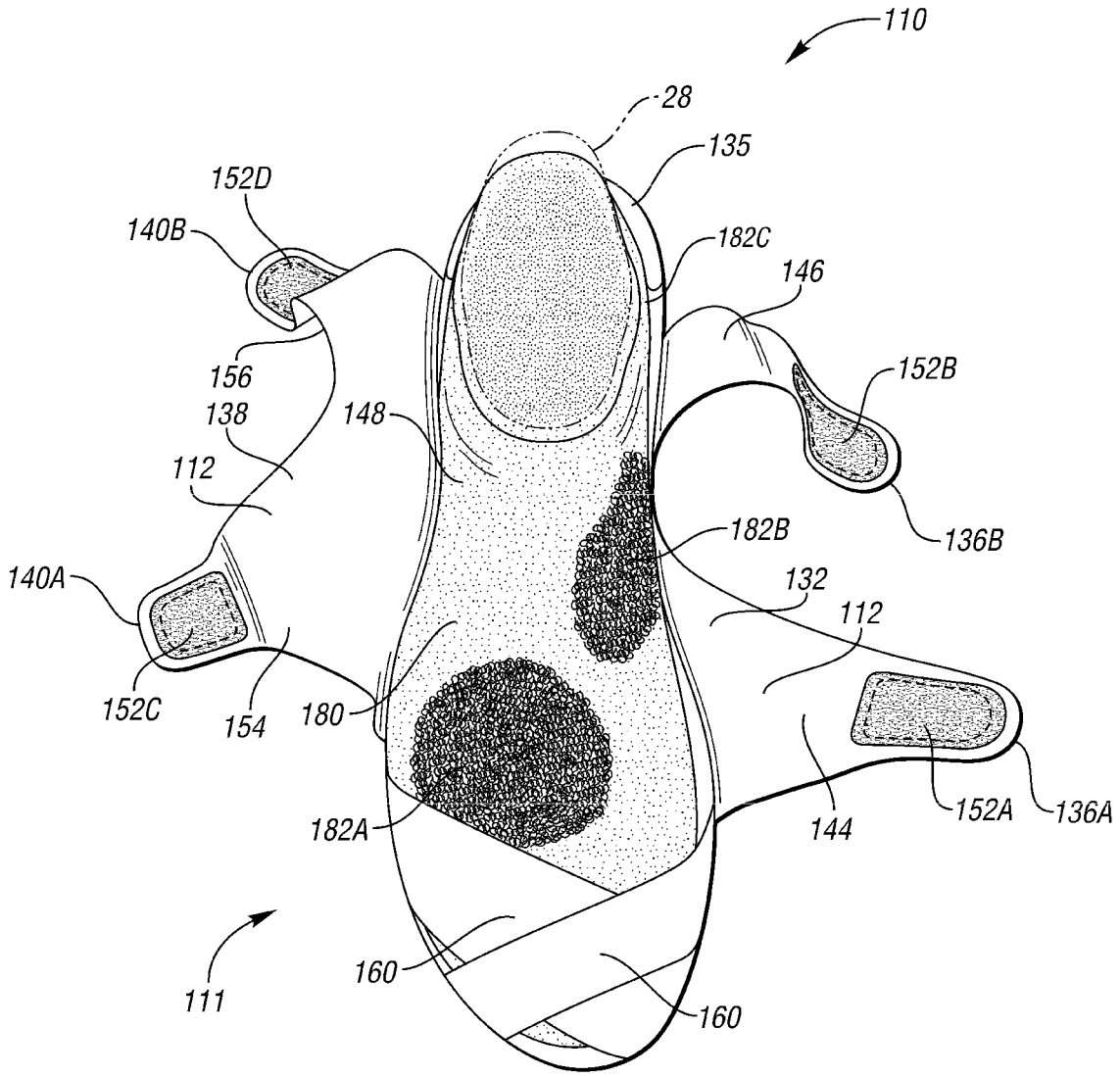
FIG. 8 is a schematic illustration in plan view of the footwear system with the sock of FIG. 6 worn on a foot shown in phantom and placed on the article of footwear of FIG. 5.

The medial side portion 132 and the lateral side portion 138 are generally flat and flexible, as best indicated in FIG. 8, and, when wrapped at least partially around the foot 28 as explained herein, extend upward from the medial side 116 and from the lateral side 118, as shown in FIGS. 9 and 10. For example, in some embodiments, the medial side portion 132 and the lateral side portion 138 may be a woven or knitted fabric or textile, rubber, or leather.

As used herein, an "end" generally refers to a distal portion of a component, and is not limited to but includes an absolute extremity of the component. The first distal end 136A and the second distal end 140A may be referred to as "free" ends as they are unfixed and freely movable relative to the sole 114, except when they are selectively secured to sock 148 as described herein.

The medial side portion 132 and the lateral side portion 138 are configured to wrap at least partially around the foot 28 positioned on the foot-receiving surface 120. The medial side portion 132 is securable at the first distal end 136A to the sock 148, and the lateral side portion 138 is separately securable to the sock 148 at the second distal end 140A remote from the medial side portion 132, when the medial side portion 132 and the lateral side portion 138 are wrapped at least partially around the foot 28 as described herein.

Referring now to FIGS. 6-7, the sock 148 includes a base portion 180, and multiple fastener portions 182A, 182B, 182C spaced from one another and surrounded by the base portion 180. Different ones of the fastener portions 182A, 182B, 182C are at least partially located on the medial side 184 of the sock 148, on the lateral side 186 of the sock 148, or on the rear 188 of the sock 148.

Figure 13A:
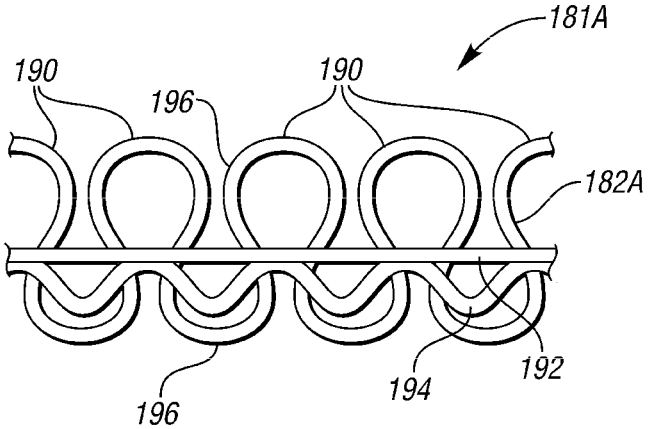
FIG. 13A is a schematic illustration in close-up fragmentary side view of a first knit configuration of a fastener portion of the sock of FIG. 6.
Figure 13B:
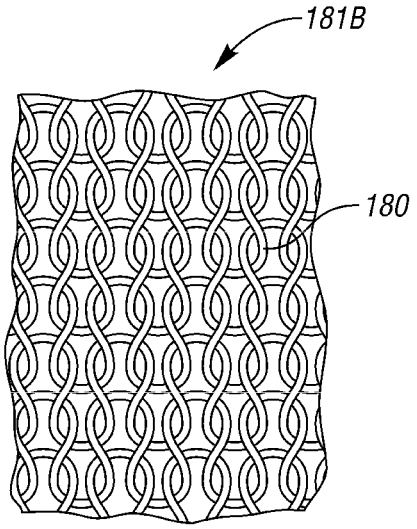
FIG. 13B is a schematic illustration in close-up fragmentary plan view of a second knit configuration of a base portion of the sock of FIG. 6.

For example, the multiple spaced fastener portions 182A, 182B, 182C may be a material of a first knit configuration 181A, shown in FIG. 13A with respect to fastener portion 182A, and the base portion 180 may be a material of a second knit configuration 181B, shown in FIG. 13B. Both the first knit configuration 181A and the second knit configuration 181B may be circular knits as shown. In one embodiment, the first knit configuration 181A includes a plurality of loops 190. More specifically, with reference to FIG. 13A, the first knit configuration 181A is a circular knit that includes laid-in yarns 192, plaiting yarns 194, and body yarns 196. One of each of these yarns is shown in FIG. 13A, which is taken at a cross-section through a laid-in yarn 192. The body yarn 196 forms the loops 190. The body yarn 196 and the plaiting yarn 194 intertwine with one another and are knit around the laid-in yarn 192. The sock 148 is disposed with the loops 190 extending on an outer surface of the sock 148 to be accessible to the fastener portion 152A. The fastener portions 182B and 182C are configured as described with respect to fastener portion 182A.

In such an embodiment, the fastener portions 152A, 152B, 152C, 152D of the upper 112 are a material with a plurality of hooks selectively securable and releasable from the loops of the fastener portions 182A, 182B, 182C of the sock 148. Alternatively, the fastener portions 152A, 152B, 152C, 152D may be a material with a plurality of loops, and the first knit configuration of the fastener portions 182A, 182B, 182C may be a plurality of hooks. In either of these embodiments, the fastener portions 152A, 152B, 152C, 152D of the upper 112 and the fastener portions 182A, 182B, 182C of the sock 148 together comprise a hook-and-loop fastening system. In still another alternative embodiment, the fastener portions 182A, 182B, 182C of the sock 148 can be hook or loop material as described, but that is sewn or otherwise secured onto the base portion 180, rather than integrally knit with the base portion 180.

The fastener portions 152A, 152B, 152C, 152D of the upper 112 are securable to different ones of the multiple spaced fastener portions 182A, 182B, 182C of the sock 148 when the medial side portion 132 and the lateral side portion 138 are wrapped at least partially around the foot 28. The size of each fastener portion 182A, 182B, and 182C of the sock 148 is generally larger than the size of the fastener portions 152A, 152B, 152C, and 152D of the upper 112. This allows for the position of each fastener portion 152A, 152B, 152C, and 152D on a selected fastener portion 182A, 182B, and 182C to be varied as desired to achieve a desired fit. For example, the position of the fastener portion 152A on fastener portion 182A could be further toward the lateral side of the fastener portion 182A for a tighter fit of the forward wing 144 around the foot 28.

As shown, both the first knit configuration 181A and the second knit configuration 181B are a circular knit. In the first knit configuration 181A of FIG. 13A, the body yarn 196 is an activatable fusible yarn and the loops 190 are hardened when the fusible yarn is activated after knitting. Only the first knit configuration 181A includes the activated fusible body yarn 196. Stated differently, the fusible body yarn 196 is introduced during the knitting process only at the fastener portions 182A, 182B, 182C. None of the yarns of the base portion 180 are fusible yarns. The fusible body yarn 196 is thus zonally knit into the sock 148 at zones that are the fastener portions 182A, 182B, 182C. The base portion 180 and the fastener portions 182A, 182B, 182C are integrally knit together by the knitting machine.

The fusible body yarn 196 is a heat activated yarn that hardens when heated. For example, the fusible yarn 196 may be an M-fusible yarn, a K85 yarn, a C85 yarn that is a combination of polyester and a low melt yarn, or a KE135 yarn. The yarn dernier of the fusible body yarn 196 is dependent upon the needle count of the machine (e.g., 120N, 132N, 144N, 160N, 168N, or 200N). After the sock 148 is knit, the fusible body yarn 196 is activated by exposing at least the fastener portions 182A, 182B, 182C or the entire sock 148 to heat, such as steam, at a specified temperature and for a specified duration. The heat and/or steam hardens the fusible body yarn 196, including the exposed loops 190. The other yarns used in the fastener portions 182A, 182B, 182C, and the yarns of the base portion 180 are of a synthetic or natural fiber that is not hardened by the heat and/or steam. By way of non-limiting example, the activation time for the fusible body yarn 196 may range from 30 seconds to 5 minutes. The hardened fusible body yarn 196 has a hardness greater than a hardness of the base portion 180 of the sock 148. Due to the activated fusible body yarn 196, the loops 190 are sufficiently hard such that they can serve as loops of a hook and loop fastener system, withstanding repeated attachment and detachment cycles throughout a typical footwear expected usable life. The loops 90 can be used as the loops in a hook-and-loop fastener system, with the fastener portions of 152A, 152B, 152C, and 152D being hooks. Alternatively, each loop 90 could be cut into hooks, either before or after hardening by activation, such that the cut, hardened loops serve as hooks in a hook-and-loop fastening system, in which case the fastener portions of 152A, 152B, 152C, and 152D are configured as loops.

A method of manufacturing a knit article as described with respect to the sock 148 includes knitting a base portion 180 of the article with a first set of yarns in a circular knit, as shown in the second knit configuration 181B of FIG. 13B. The method includes introducing a fusible body yarn 196, and knitting at least one fastener portion 182A, 182B, or 182C of the article integrally with the base portion 180 in a circular knit with the fusible yarn 196 as a body yarn with loops 190. The loops 190 may be knit as terry loops. Depending on the machine used to knit, the loops 190 may initially be on the inner surface of the knit article, but the inner surface can be configured to serve as the outer surface of the finished article simply by turning the knit article "inside out". Alternatively, if a terry loop circular knit process is not implemented, the loops 190 could instead be provided in the circular knit by a mesh structure using floats that pull the body yarn 196 out away from the plaiting yarn 194 and the laid-in yarn 192, forming loops 190.

After knitting the base portion 180 and the fastener portions 182A, 182B, 182C, with the fastener portions 182A, 182B, 182C having the loops 190 as described (whether knit as terry loops or pulled out using a mesh structure with floats), the method then includes activating the fusible body yarn 196, such as by heating and/or steaming the sock 148, such that the loops 190 harden. Optionally, the loops 190 may be cut either before or after activating, such that the hardened fusible body yarn 196 has hooks. Although the method is described with respect to a sock 148, the method may be used to manufacture other knit articles such as apparel or footwear, including a footwear upper.

To secure the footwear system 110 to the foot 28 as shown in FIGS. 9-12, the sock 148 is first placed on the foot 28. The foot 28 with the sock 148 thereon is then slipped under the straps 160 and onto the foot-receiving surface 120 of the sole 114. The fastener portions 152A, 152B, 152C, and 152D can be secured to the sock 148 in any order. In the embodiment shown, the medial side portion 132 is secured prior to the lateral side portion by lifting the first distal end 136A of the forward wing 144 and pulling it over the foot 28 toward the lateral side 118 to wrap the medial side portion 132 at least partially around the foot 28, and the fastener portion 152A is then secured to the fastener portion 182A. The distal end 136B of the rearward wing 146 is pulled around the back of the foot 28 to further wrap the medial side portion at least partially around the foot 28, and the fastener portion 152B is then secured to the fastener portion 182C.

Next, the lateral side portion 138 is secured by lifting the second distal end 140A of the forward wing 154 and pulling it over the foot 28 toward the medial side 116 to wrap the lateral side portion 138 at least partially around the foot 28, and the fastener portion 152C is then secured to the fastener portion 182B. Finally, the distal end 140B of the rearward wing 156 is pulled around the back of the foot 28 to further wrap the lateral side portion 138 at least partially around the foot 28, and the fastener portion 152D is then secured to the fastener portion 182C. As is apparent in FIG. 12, the rearward wing 156 partially overlaps the rearward wing 154, but is secured to the fastener portion 182C separately from the rearward wing 154. Optionally, the outer surface of the rearward wing 154 could have a fastener portion so that the rearward wing 156 could secure to the rearward wing 154 in addition to or instead of the fastener portion 182C. In such an embodiment, the medial side portion 132 would still be separately securable to the sock 148 remote from the lateral side portion 138, as the distal end 136A would still be separately securable remote from the distal end 140A.

It should be appreciated that the order of securing the fastener portions 152A, 152B, 152C, 152D as described is only one example, and any other order can be used. To remove the article of footwear 111, the fastener portions 152A, 152B, 152C, 152D are unfastened in reverse order, or any suitable order, and the medial and lateral side portions 132, 138 are thereby unwrapped from around the foot 28. The foot 28 can then be lifted off of the foot-receiving surface 120, and the forefoot portion slipped out from under the straps 160.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The invention claimed is:

1. A footwear system comprising: an article of footwear including: a sole having a medial side, a lateral side, and a foot-receiving surface; an upper having:

a medial side portion that is fixed to the medial side of the sole and has a forward wing with a first distal end;

a lateral side portion that is fixed to the lateral side of the sole and has a forward wing with a second distal end;

a strap fixed at a medial end to a periphery of the sole at the medial side of the sole, and fixed at a lateral end to the periphery of the sole at the lateral side of the sole, the strap spanning across the sole over a foot-receiving surface of the sole at a forefoot portion of the sole; and a sock; the sock being made of a base portion and multiple fastener portions; the multiple fastener portions disposed above a sole of the sock; and the base portion of the sock extending along the sole of the sock and above the sole of the sock, and surrounding the multiple fastener portions; the multiple fastener portions including a first fastener portion disposed at least partially on a lateral side of the sock, and a second fastener portion disposed at least partially on a medial side of the sock;

wherein:

the forward wing of the medial side portion and the forward wing of the lateral side portion are configured to wrap at least partially around the sock when the sock is worn on a foot slipped under the strap and positioned by a wearer on the foot-receiving surface;

the forward wing of the medial side portion includes a fastener portion fixed to the first distal end;

the forward wing of the lateral side portion includes a fastener portion fixed to the second distal end;

the fastener portion of the forward wing of the medial side portion is securable to the first fastener portion of the sock at the lateral side of the sock when the forward wing of the medial side portion is wrapped at least partially around the sock; and the fastener portion of the forward wing of the lateral side portion is separately securable to the second fastener portion of the sock at the medial side of the sock when the forward wing of the lateral side portion is wrapped at least partially around the sock without overlapping the forward wing of the medial side portion.

2. The footwear system of claim 1, wherein: the multiple fastener portions of the sock include a first knit configuration; and the base portion of the sock includes a second knit configuration different from the first knit configuration and knit integrally with the first knit configuration.

3. The footwear system of claim 2, wherein the first knit configuration is a circular knit with a fusible body yarn having hardened loops.

4. The footwear system of claim 3, wherein only the first knit configuration includes the fusible body yarn.

5. The footwear system of claim 1, wherein the first fastener portion and the second fastener portion of the sock are spaced from one another.

6. The footwear system of claim 1, wherein: the medial side portion has a rearward wing that wraps at least partially rearward around the sock worn on the foot; the lateral side portion has a rearward wing that wraps at least partially rearward around the sock worn on the foot.

7. The footwear system of claim 6, wherein the multiple fastener portions include a third fastener portion, and the rearward wing of the medial side portion and the rearward wing of the lateral side portion each have an additional fastener portion at least one of which is securable to the third fastener portion of the sock when the medial side portion and the lateral side portion are wrapped at least partially around the sock worn on the foot.

8. The footwear system of claim 7, wherein one of the rearward wing of the medial side portion and the rearward wing of the lateral side portion crosses over the other of the rearward wing of the medial side portion and the rearward wing of the lateral side portion and secures to said third fastener portion of the sock at a heel region of the sock.

9. The footwear system of claim 5, wherein: the multiple fastener portions of the sock include a first knit configuration; and the base portion of the sock includes a second knit configuration different from the first knit configuration.

10. The footwear system of claim 5, wherein: either the fastener portion of the medial side portion and the fastener portion of the lateral side portion include a plurality of hooks and the multiple fastener portions of the sock include a plurality of loops that are securable to the plurality of hooks, or the fastener portion of the medial side portion and the fastener portion of the lateral side portion include a plurality of loops and the multiple fastener portions of the sock include a plurality of hooks that are securable to the plurality of loops of the fastener portion of the medial side portion and the fastener portion of the lateral side portion.

11. The footwear system of claim 1, wherein the first fastener portion of the sock is larger than the fastener portion of the forward wing of the medial side portion.

12. The footwear system of claim 1, wherein the second fastener portion of the sock is larger than the fastener portion of the forward wing of the lateral side portion.

13. The footwear system of claim 1, wherein the strap is a first forefoot strap, and the footwear system further comprising: a second forefoot strap fixed at a medial end to the periphery of the sole at the medial side of the sole, and fixed at a lateral end to the periphery of the sole at the lateral side of the sole, the second forefoot strap spanning across the sole over the foot-receiving surface at the forefoot portion of the sole and crossing over the first forefoot strap.

14. A footwear system comprising: an article of footwear including: a sole having a medial side, a lateral side, and a foot-receiving surface;

an upper having:

a medial side portion that is fixed to the medial side of the sole and has a first distal end;

a lateral side portion that is fixed to the lateral side of the sole and has a second distal end; and a strap fixed at a medial end to a periphery of the sole at the medial side of the sole, and fixed at a lateral end to the periphery of the sole at the lateral side of the sole, the strap spanning across the sole over a foot-receiving surface of the sole at a forefoot portion of the sole; and a sock; the sock being made of a base portion and multiple fastener portions; the multiple fastener portions disposed above a sole of the sock; and the base portion of the sock extending along the sole of the sock and above the sole of the sock, and surrounding the multiple fastener portions; the multiple fastener portions including a first fastener portion disposed at least partially on a lateral side of the sock, and a second fastener portion disposed at least partially on a medial side of the sock;

wherein:

the medial side portion and the lateral side portion are configured to wrap at least partially around the sock slipped under the strap and positioned by a wearer on the foot-receiving surface; and the medial side portion is securable at the first distal end, and the lateral side portion is separately securable at the second distal end remote from the medial side portion when the medial side portion and the lateral side portion are wrapped at least partially around the sock.

15. The footwear system of claim 14, further comprising: the sock configured to be worn on the foot and positioned on the foot-receiving surface of the sole: wherein: the medial side portion includes a fastener portion fixed to the first distal end; and the fastener portion of the medial side portion is securable to the second fastener portion of the sock when the medial side portion is wrapped at least partially around the sock.

16. The footwear system of claim 14, further comprising: the sock configured to be worn on the foot and positioned on the foot-receiving surface; wherein: the lateral side portion includes a first fastener portion fixed to the second distal end; and the fastener portion of the lateral side portion is securable to the first fastener portion of the sock when the lateral side portion is wrapped at least partially around the sock.

17. The footwear system of claim 15, wherein: the multiple fastener portions of the sock include a first knit configuration; and the base portion of the sock includes a second knit configuration different from the first knit configuration.

* * * * *